US005740503A

United States Patent [19]

Nakamura

[11] Patent Number: 5,740,503

[45] Date of Patent: Apr. 14, 1998

[54] IMAGE FORMING MACHINE INCLUDING APPARATUS FOR SELECTIVELY CONNECTING A ROTARY BRUSH TO A MOTOR

[75] Inventor: Toshiyuki Nakamura, Osaka, Japan

[73] Assignee: Mita Industrial Co., Ltd., Osaka, Japan

[21] Appl. No.: 821,341

[22] Filed: Mar. 20, 1997

[30] Foreign Application Priority Data

Mar. 23, 1996 [JP] Japan ..... 8-093661

[51] Int. Cl.[6] ..... G03G 15/00; G03G 21/00

[52] U.S. Cl. ..... 399/167; 399/353

[58] Field of Search ..... 399/167, 320, 399/343, 345, 353; 15/256.5–256.52

[56] References Cited

U.S. PATENT DOCUMENTS

| | | | |
|---|---|---|---|
| 4,465,357 | 8/1984 | Mugrauer et al. | 399/167 X |
| 4,806,968 | 2/1989 | Watanabe et al. | 399/167 X |
| 5,294,958 | 3/1994 | Isobe et al. | 399/167 X |

*Primary Examiner*—William J. Royer
*Attorney, Agent, or Firm*—Beveridge, DeGrandi, Weilacher & Young, LLP

[57] ABSTRACT

An image forming machine comprising a rotating drum having an electrostatic photoconductor on the peripheral surface thereof; a latent electrostatic image forming means for forming a latent electrostatic image on the electrostatic photoconductor; a developing means for developing the latent electrostatic image on the electrostatic photoconductor to a toner image; a transfer means for transferring the toner image on the electrostatic photoconductor onto a sheet member; a cleaning means for removing a residual toner remaining on the electrostatic photoconductor after transfer; and a fixing means for fixing the toner image, transferred onto the sheet member, onto the sheet member is provided. The rotating drum is rotationally driven by a first electric motor, and the fixing means is rotationally driven by a second electric motor. The cleaning means includes a rotary brush means in contact with the peripheral surface of the rotating drum. A selectively connecting means is disposed which can be selectively set in an operating state for drivingly connecting the rotary brush means to the second electric motor to transmit the rotation of the electric motor to the rotary brush means, and in a nonoperating state for cutting off the rotary brush means from the second electric motor. The selectively connecting means is set in the operating state only when the rotating drum is to be rotated.

5 Claims, 4 Drawing Sheets

IMAGE FORMING MACHINE INCLUDING APPARATUS FOR SELECTIVELY CONNECTING A ROTARY BRUSH TO A MOTOR

FIELD OF THE INVENTION

This invention relates to an image forming machine such as a copier, a facsimile or a printer. More specifically, it relates to an image forming machine of the type in which a cleaning means for removing a residual toner from the peripheral surface of a rotating drum includes a rotary brush means.

DESCRIPTION OF THE PRIOR ART

An image forming machine, such as a copier, a facsimile or a printer, which is of the type including a rotating drum having an electrostatic photoconductor disposed on the peripheral surface thereof, finds wide use. Around the rotating drum, a latent electrostatic image formation zone, a development zone, a transfer zone, and a cleaning zone are disposed in this order. In the latent electrostatic image formation zone, a latent electrostatic image is formed on the electrostatic photoconductor by the action of a latent electrostatic image forming means. In the development zone, the latent electrostatic image on the electrostatic photoconductor is developed to a toner image by the action of a developing means. In the transfer zone, the toner image on the electrostatic photoconductor is transferred onto a sheet member which may be a sheet of paper. In the cleaning zone, toner remaining on the electrostatic photoconductor after transfer is removed from the electrostatic photoconductor. The sheet member having the toner image transferred onto it is conveyed through a fixing zone. In the fixing zone, the toner image is fixed onto the sheet member by the action of a fixing means.

As a cleaning means, one of the type including a rotary brush means to be brought into contact with the peripheral surface of the rotating drum is preferably used in addition to, or instead of, a cleaning blade of synthetic rubber to be pressed against the peripheral surface of the rotating drum. The rotary brush means is constructed, for example, by spirally wrapping a band-like piece about a rotary shaft, the band-like piece comprising a multiplicity of plastic yarns one end of each of which is bonded to an adhesive layer solidified in the form of a band.

In the image forming machine of the above-described type, it is necessary that the rotating drum, developing means, cleaning means and fixing means be driven as required. A transport means for transporting the sheet member through the transfer zone should also be driven where necessary. Disposing many electric motors for these means to be driven results necessarily in increased production cost. In a typical example of the image forming machine, therefore, the rotating drum and the rotary brush means of the cleaning means are driven by a common first electric motor, the fixing means is driven by a second electric motor, and the developing means and the transport means are driven by a common third electric motor.

A conventional image forming machine, however, poses the following problem to be solved: When the rotating drum and the rotary brush means are not rotated, but at a standstill, only a specific angle site of the rotary brush means is kept in contact with the peripheral surface of the rotating drum. Thus, a local recess, i.e., a part where the yarns are deformed to extend obliquely in the peripheral direction, tends to be formed at the specific angle site of the rotary brush means.

If such a local recess is formed in the rotary brush means, there will be a considerable change in a load on the rotary brush means during rotation. A change in the load on the rotary brush means will cause a change in the peripheral speed of the output shaft of the first electric motor which rotationally drives the rotating drum along with the rotary brush means, thus generating a change in the peripheral speed of the rotating drum. The change in the peripheral speed of the rotary brush means will not bring about a serious problem. Whereas the change in the peripheral speed of the rotating drum will cause a defect, such as distortion, in a latent electrostatic image to be formed on the electrostatic photoconductor disposed on the peripheral surface of the rotating drum, and eventually in a toner image to be obtained by the development of the latent electrostatic image.

SUMMARY OF THE INVENTION

A principal object of the present invention is to provide an improved image forming machine in which even if a local recess is formed in the rotary brush means, and a load on the rotary brush means during rotation is considerably changed, an undesirable change in the peripheral speed of the rotating drum will not occur, and a defect, such as distortion, will not be caused to a latent electrostatic image formed on the electrostatic photoconductor disposed on the peripheral surface of the rotating drum, or to a toner image obtained by the development of the latent electrostatic image.

To attain the principal object, the invention disposes a selectively connecting means for selectively connecting the rotary brush means not to the first electric motor for driving the rotating drum, but to the second electric motor for driving the fixing means.

In detail, the invention provides as an image forming machine attaining the principal object, an image forming machine comprising a rotating drum having an electrostatic photoconductor on the peripheral surface thereof; a first electric motor for rotating the rotating drum; a latent electrostatic image forming means for forming a latent electrostatic image on the electrostatic photoconductor; a developing means for developing the latent electrostatic image on the electrostatic photoconductor to a toner image; a transfer means for transferring the toner image on the electrostatic photoconductor onto a sheet member; a cleaning means for removing a residual toner remaining on the electrostatic photoconductor after transfer, the cleaning means including a rotary brush means in contact with the peripheral surface of the rotating drum; a fixing means for fixing the toner image, transferred onto the sheet member, onto the sheet member; a second electric motor for driving the fixing means; and a control means; wherein a selectively connecting means is disposed which can be selectively set in an operating state for drivingly connecting the rotary brush means to the second electric motor to transmit the rotation of the electric motor to the rotary brush means, and in a nonoperating state for cutting off the rotary brush means from the second electric motor, and the control means sets the selectively connecting means in the operating state only when the rotating drum is to be rotated.

There may be a case in which the rotary brush means is not selectively, but always connected to the second electric motor so that whenever the second electric motor is energized, the rotary brush means is rotated. In this case, however, the following problem arises: Generally, the fixing means is equipped with a heating means, and when an image formation process is to be started, it is important that a member constituting the fixing means, such as a roller, be heated fully uniformly to a required temperature throughout the region of action of the member. When a so-called main switch (power switch) of the image forming machine is turned on, therefore, the heating means provided in the fixing means is energized, and simultaneously, the second electric motor is energized to begin driving the fixing means, before the image formation process is started with the rotating drum being rotated. If the rotary brush means is always connected to the second electric motor, the rotary brush means is rotated, although the rotating drum is kept to a halt. As a result, a specific angle site of the electrostatic photoconductor at a standstill is continuously rubbed against the rotary brush means, whereby the specific angle site of the electrostatic photoconductor may be locally damaged.

It is also conceivable to connect the rotary brush means to the third electric motor for driving the developing means and the transport means, rather than to the second electric motor for driving the fixing means. When the rotary brush means is connected to the third electric motor, however, there will be a change in the driving of the developing means and the transport means, because of a change in the load on the rotary brush means during rotation. Consequently, a defect, such as distortion, tends to occur in a toner image formed on the electrostatic photoconductor, and the toner image transferred from the electrostatic photoconductor onto an image bearing member. In the present invention, on the other hand, the rotary brush means is connected to the second electric motor. Thus, some change may be caused to the driving of the fixing means. Should some change occur in the driving of the fixing means, the present invention is free from such a problem that the toner image fixed is distorted.

In a preferred embodiment, the selectively connecting means includes a pair of transmission gears; a connection control gear disposed so as to be movable between a connecting position at which the connection control gear engages both of the pair of transmission gears to drivingly connect together the pair of transmission gears, and a non-connecting position at which the connection control gear is separated from at least one of the pair of transmission gears to cut off the pair of transmission gears from each other; and a moving means for selectively moving the connection control gear to the connecting position and the non-connecting position. The connection control gear is mounted on a movable bracket mounted so as to be turnably movable about the central axis of one of the pair of transmission gears. It is preferred that the moving means selectively moves the connection control gear to the connecting position and the non-connecting position when the movable bracket is moved. The moving means may be composed of a solenoid. The fixing means advantageously includes a driven roller and a follower roller which cooperatively work, and a heating means provided in at least one of the driven roller and the follower roller.

DETAILED DESCRIPTION OF THE PREFERRED EMBODIMENTS

Preferred embodiments of an image forming machine constructed in accordance with the present invention will be described in detail with reference to the accompanying drawings.

Figure 1:
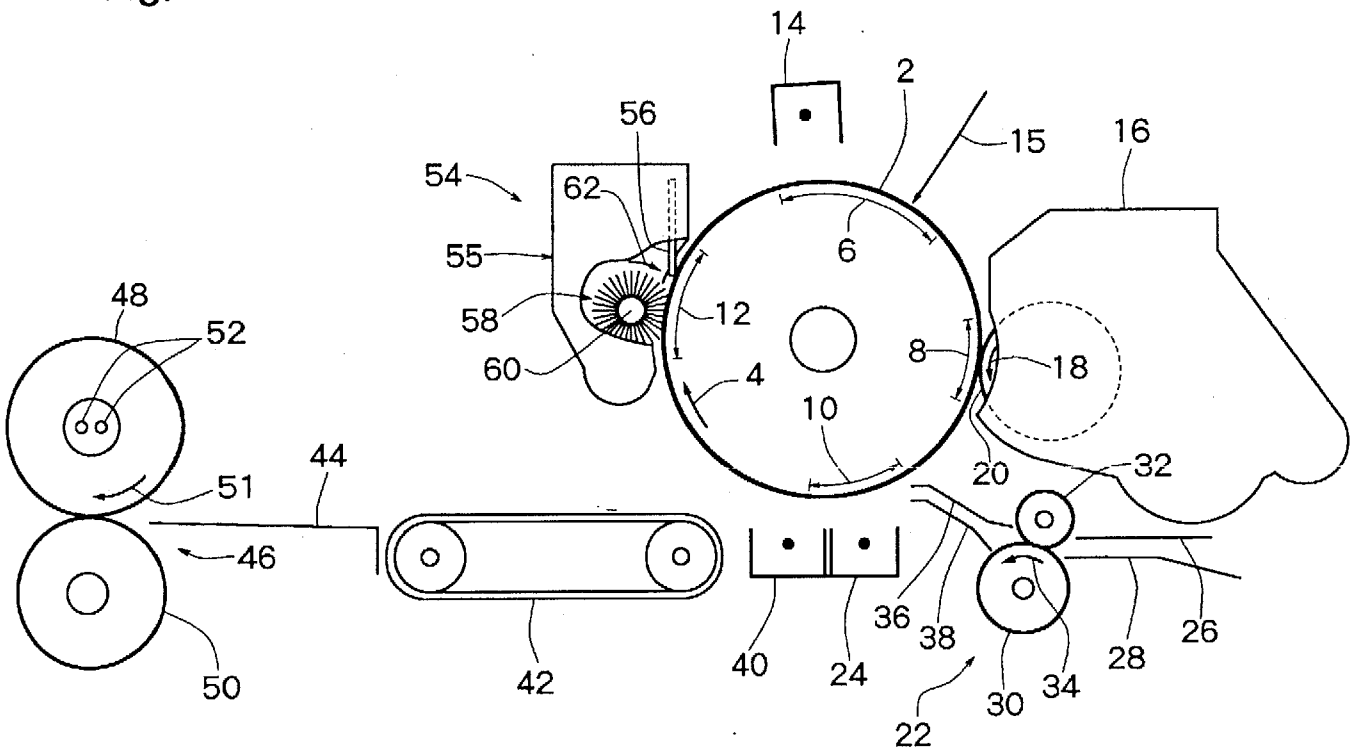
FIG. 1 is a schematic view illustrating a preferred embodiment of an image forming machine constructed in accordance with the present invention.

FIG. 1 schematically shows main constituent elements of a preferred embodiment of an image forming machine constructed in accordance with the present invention. The illustrated image forming machine has a rotatably mounted rotating drum 2. On the peripheral surface of the rotating drum 2, an electrostatic photoconductor is disposed. Around the rotating drum 2 to be rotated in the direction of an arrow 4, a latent electrostatic image formation zone 6, a development zone 8, a transfer zone 10 and a cleaning zone 12 are disposed in this order. In the latent electrostatic image formation zone 6, the electrostatic photoconductor disposed on the peripheral surface of the rotating drum 2 is charged uniformly to a specific polarity by the action of a charging corona discharge means 14. Then, under the action of a light illumination means (not shown), the electrostatic photoconductor is illuminated with light in correspondence with an image to be formed, as briefly illustrated by an arrow 15, whereby the electrostatic photoconductor is destaticized. Thus, a latent electrostatic image corresponding to the image to be formed is formed on the electrostatic photoconductor. The charging corona discharge means 14 and the light illumination means constitute a latent electrostatic image forming means for forming the latent electrostatic image on the electrostatic photoconductor. In the development zone 8, the latent electrostatic image on the electrostatic photoconductor is developed to a toner image by the action of a developing means 16. Advantageously, the developing means 16 is of the type having a developing roller 20 to be rotated in the direction of an arrow 18. In the transfer zone 10, the surface of a sheet member (not shown) to be fed by the action of a transport means 22 is brought into intimate contact with the electrostatic photoconductor disposed on the surface of the rotating drum 2. To the back of the sheet member which may be a sheet of paper, a corona discharge is applied by a transfer corona discharge means 24 constituting a transfer means, whereupon the toner image on the electrostatic photoconductor is transferred onto the sheet member. The transport means 22 includes a guide plate pair (26, 28), driven rollers 30 and 32 that collaboratively work, and a guide plate pair (36, 38). The driven rollers 30 and 32 are rotated in the direction of an arrow 34 in required synchronism with the rotation of the rotating drum 2 to convey the sheet member delivered from a supply source (not shown), which may be a cassette, through the transfer zone 10. Downstream from the transfer zone 10, the sheet member is stripped from the electrostatic photoconductor by the action of a corona discharge which is applied to the back of the sheet member by a peeling corona discharge means 40. The transport means 22 also includes a conveyor belt mechanism 42 and a guide plate 44 to convey the sheet member peeled from the electrostatic photoconductor to the fixing means 46. The fixing means 46 includes a driven roller 48 and a follower roller 50 which cooperatively work. The driven roller 48 and the follower roller 50 pressed against it are rotated in the direction of an arrow 51. Inside the driven roller 48, a heating means 52, optionally a halogen lamp, is disposed. The toner image transferred onto the sheet member is fixed onto the sheet member during the passage of the sheet member through the fixing means 46. The sheet member having the toner image fixed is discharged onto a receiving tray (not shown).

With reference to FIG. 1, a toner remaining on the electrostatic photoconductor after transfer is removed from the electrostatic photoconductor by the action of a cleaning means 54. In the illustrated embodiment, the cleaning means 54 includes a housing 55 mounted at a predetermined position. In the housing 55, a rotary brush means 58 is disposed along with a cleaning blade 56 of synthetic rubber whose front end is to be pressed against the electrostatic photoconductor. The rotary brush means 58 may be formed by spirally wrapping a band-like piece about a rotary shaft 60, the band-like piece comprising a multiplicity of plastic yarns one end of each of which is bonded to an adhesive layer solidified in the form of a band. The rotary brush means 58 is in contact with the electrostatic photoconductor disposed on the peripheral surface of the rotating drum 2, and is rotated in the direction of an arrow 62 in harmony with the rotation of the rotating drum 2. (The rotation of the rotary drum means 58 will be further described later.)

Figure 2:
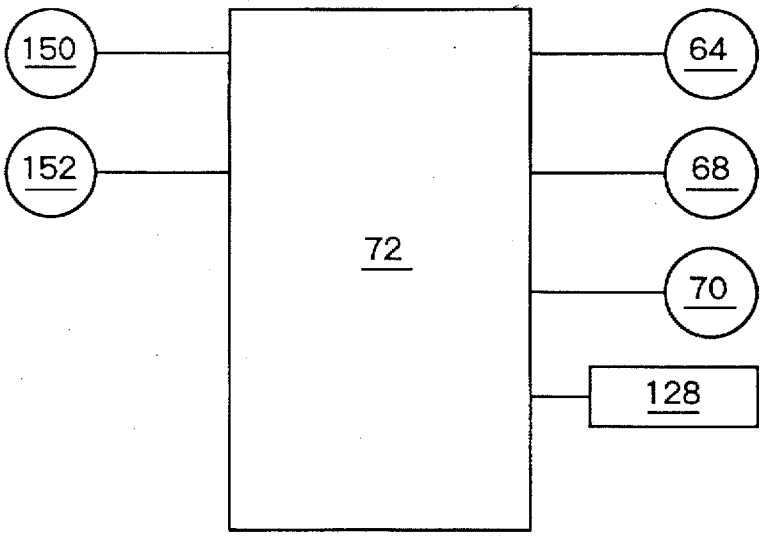
FIG. 2 is a block diagram showing a control means and related elements in the image forming machine of FIG. 1.

Referring to FIG. 2 together with FIG. 1, the rotating drum 2 is connected to an electric motor 64 (a first electric motor) via a connecting means (not shown) including a reduction mechanism. When the electric motor 64 is energized, the rotating drum 2 is rotationally driven at a predetermined speed in the direction of arrow 4. The driven roller 48 of the fixing means 46 is connected to an electric motor 68 (a second electric motor) via a connecting means 66 (the connecting means 66 will be further described later). When the electric motor 68 is energized, the driven roller 48 is rotated in the direction of the arrow 51. The developing roller 20 in the developing means 16, and the driven roller 30 and conveyor belt mechanism 42 in the transport means 22 are connected to a common electric motor 70 (a third electric motor) via suitable connecting means (not shown). The connecting means disposed between the developing roller 20 and the electric motor 70 includes a clutch means. The connecting means disposed between the driven roller 30 and the electric motor 70 also includes a clutch means. When the electric motor 70 is energized, the conveyor belt mechanism 42 is rotated, and upon further energization of the clutch means, the developing roller 20 and the feed roller pair (30, 32) are rotated. The energization and deenergization of the electric motors 64, 66 and 70 and the clutch means are controlled by a control means 72 which may be composed of a microprocessor.

The foregoing structure of the illustrated image forming machine does not constitute a novel characteristic of the image forming machine constructed in accordance with the present invention, but may be one well known to those skilled in the art. A detailed description of this structure is therefore omitted in the specification of the present application.

Figure 3:
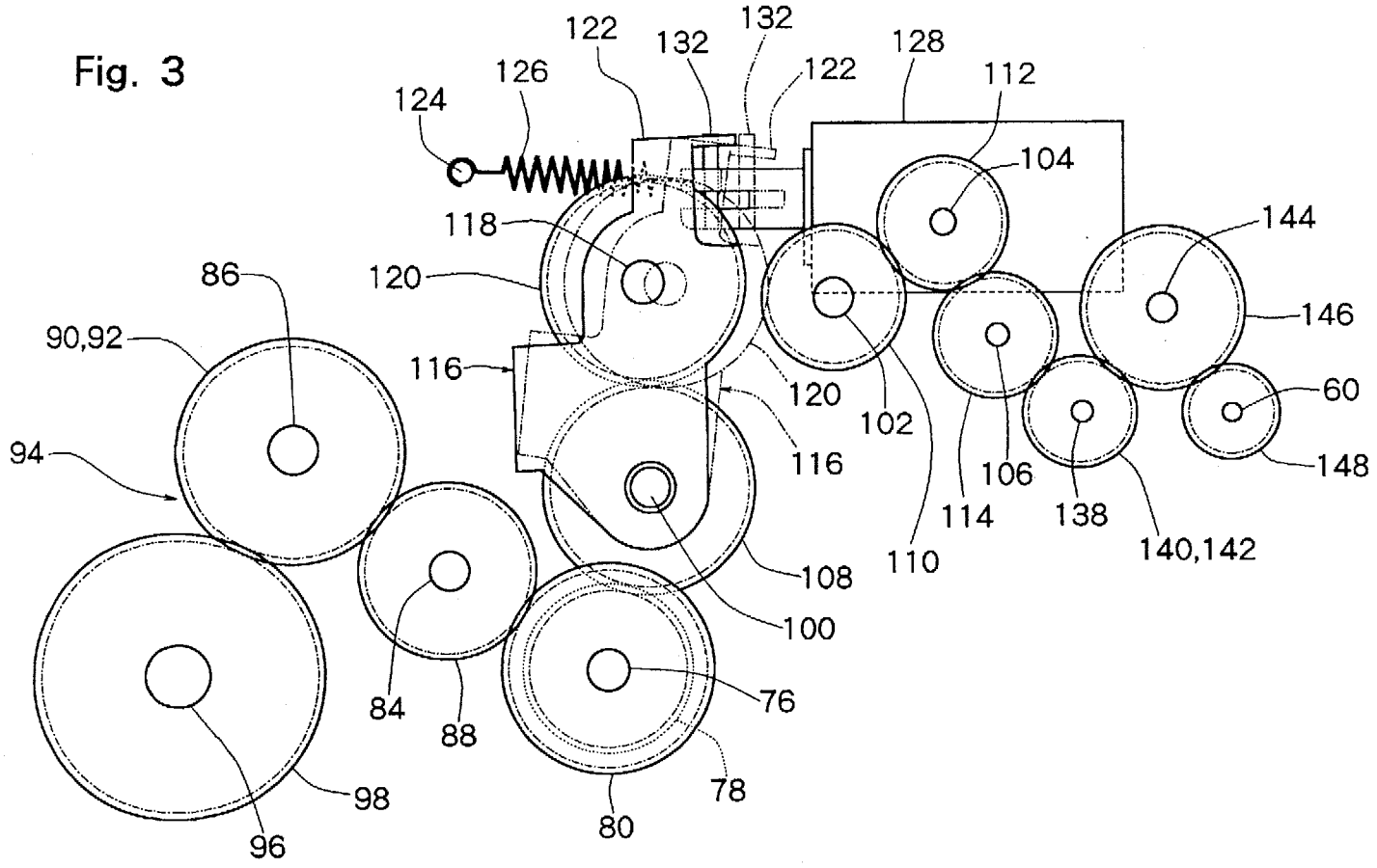
FIG. 3 is schematic view showing a connecting means for connection between a second electric motor and a fixing means, and a selectively connecting means for selective connection between the second electric motor and a rotary brush means of a cleaning means, in the image forming machine of FIG. 1.
Figure 4:
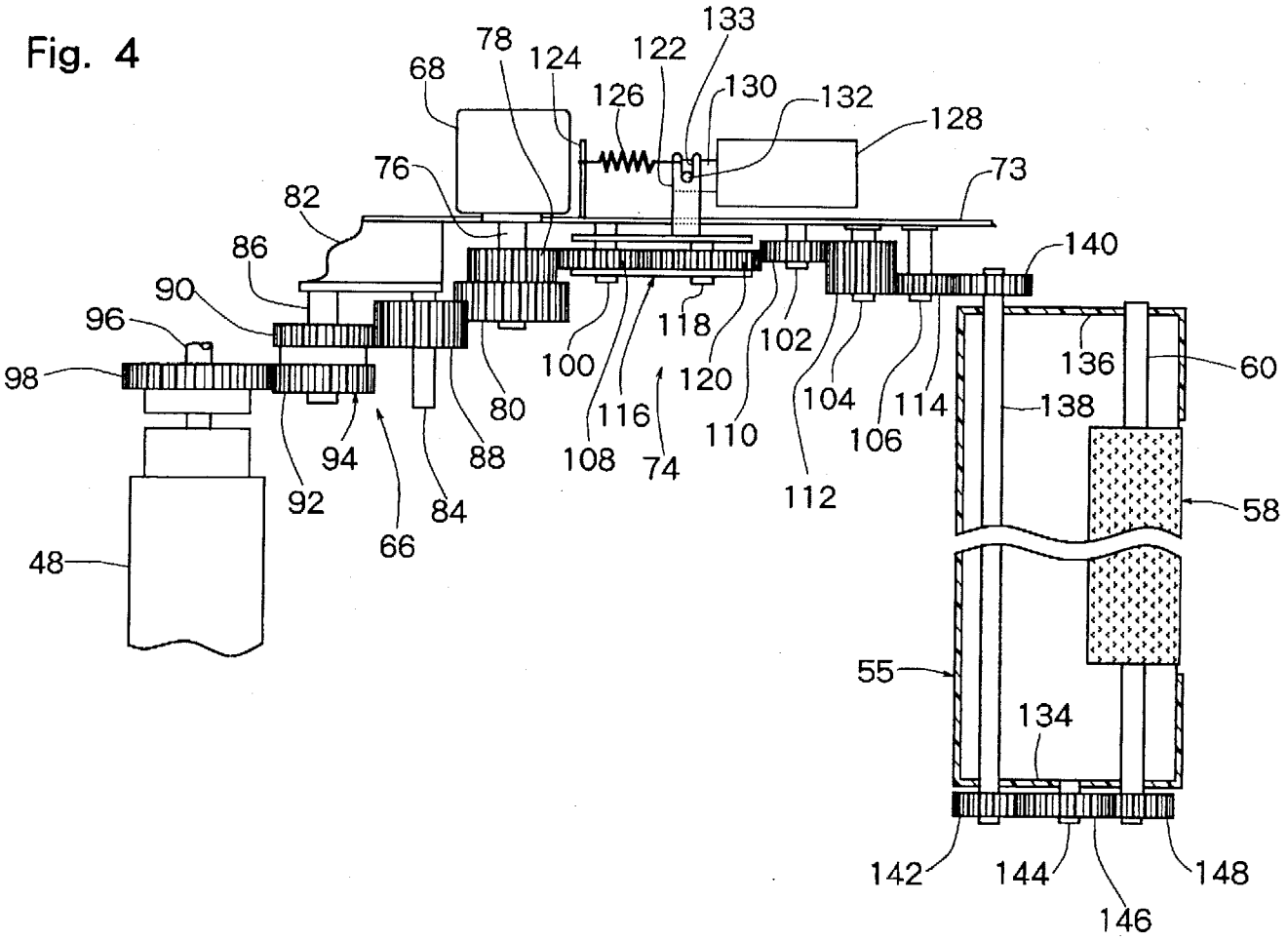
FIG. 4 is a plan view showing the connecting means for connection between the second electric motor and the fixing means, and the selectively connecting means for selective connection between the second electric motor and the rotary brush means of the cleaning means, in the image forming machine of FIG. 1.

By reference to FIGS. 3 and 4, the illustrated image forming machine has a pair of upright plates, i.e., a front upright plate (not shown) and a rear upright plate 73 (FIG. 4) disposed with spacing in the back-and-forth direction. As illustrated clearly in FIG. 4, the electric motor 68 is mounted on the rear surface of the rear upright plate 73. To the electric motor 68, advantageously a direct-current servomotor, the driven roller 48 of the fixing means 46 is connected via the connecting means 66, and the rotary brush means 58 of the cleaning means 54 is connected via the selectively connecting means 74. In further detail, an output shaft 76 of the electric motor 68 is protruded substantially horizontally forward through the rear upright plate 73. To this protruding end portion of the output shaft 76, two transmission gears 78 and 80 are fixed. To the front surface of the rear upright plate 73, a support bracket piece 82 is fixed. To this bracket piece 82, short shafts 84 and 86 extending substantially horizontally are fixed. On the short shaft 84, a transmission gear 88 is mounted rotatably. On the short shaft 86, a rotary member 94 having transmission gears 90 and 92 formed integrally therewith is mounted rotatably. The driven roller 48 of the fixing means 46 is fixed to a support shaft 96 extending substantially horizontally. The support shaft 96 is rotatably mounted between the front upright plate and the rear upright plate 73. To the support shaft 96, a transmission gear 98 is fixed. The transmission gear 88 is engaged with the transmission gear 80, and also engaged with the transmission gear 90 of the rotary member 94. The transmission gear 92 of the rotary member 94 is engaged with the transmission gear 98. Thus, the output shaft 76 of the electric motor 68 is connected to the support shaft 96, which has the driven roller 48 fixed thereto, via the transmission gear 80, transmission gear 88, rotary member 94 having the transmission gears 90 and 92, and the transmission gear 98. Thus, when the electric motor 68 is energized to rotate its output shaft 76 in a predetermined direction, the driven roller 48 of the fixing means 46 is rotated in the direction of the arrow 51 (FIG. 1). The transmission gears 80 and 88, rotary member 94 having the transmission gears 90 and 92, and the transmission gear 98 constitute the connecting means 66.

Next, the selectively connecting means 74 disposed between the electric motor 68 and the rotary brush means 58 of the cleaning means 54 will be described by reference to FIGS. 3 and 4. To the rear upright plate 73, short shafts 100, 102, 104 and 106 protruding substantially horizontally forward are fixed. To the short shaft 100, a transmission gear 108 is mounted rotatably. To the short shaft 102, a transmission gear 110 is mounted rotatably. To the short shaft 104, a transmission gear 112 is mounted rotatably. To the short shaft 106, a transmission gear 114 is mounted rotatably. The transmission gear 108 is engaged with the transmission gear 78 fixed to the output shaft 76 of the electric motor 68. The transmission gear 112 is engaged with the transmission gear 110, and also engaged with the transmission gear 114. As will be seen clearly from FIG. 3, a movable bracket 116 is turnably mounted on the short shaft 100. To the movable bracket 116, a short shaft 118 extending substantially horizontally is fixed. On the short shaft 118, a connection control gear 120 is rotatably mounted. The movable bracket 116 has an arm 122 which extends rearward through an opening (not shown) formed in the rear upright plate 73. To the rear upright plate 73, a pin 124 extending rearward is fixed. Between the pin 124 and the front end of the arm 122 of the movable bracket 116, a tension spring 126 is provided. On the rear surface of the rear upright plate 73, a solenoid 128 is mounted which constitutes a moving means for moving the movable bracket 116. To the front end of a plunger 130 of the solenoid 128, a pin 132 protruding upward is fixed. At the front end of the arm of the movable bracket 116, a groove 133 extending in the back-and-forth direction is formed. An upper end portion of the pin 132 is inserted through this groove 133. When the movable bracket 116 is a magnetic body, the pin 132 is advantageously formed of a non-magnetic body in order to prevent the phenomenon that a magnetic loop generated when the electromagnet disposed in the solenoid 128 is energized extends as far as the movable bracket 116, and its magnetic force decreases. When the solenoid 128 is deenergized, the movable bracket 116 is brought to a non-connecting position shown in FIG. 4 and indicated by a solid line in FIG. 3 by the elastic action of the tension spring 126. When the movable bracket 116 is located at this non-connecting position, the connection control gear 120 mounted on the movable bracket 116 is engaged with the transmission gear 108, but is separated from the transmission gear 110. When the solenoid 128 is energized to have its plunger 130 retracted, the movement of the plunger 130 is transmitted to the movable bracket 116 via the pin 132. The movable bracket 116 is turned about the short shaft 100, accordingly about the central axis of the transmission gear 108, to be brought to a connecting position indicated by a two-dot chain line in FIG. 3. Thus, the connection control gear 120 mounted on the movable bracket 116 is caused to revolve round the transmission gear 108, and is engaged with the transmission gear 110 as well as the transmission gear 108. Thus, the transmission gears 108 and 110 are connected together by the connection control gear 120.

As illustrated clearly in FIG. 4, the housing 55 of the cleaning means 54 has a front wall 134 and a rear wall 136. On the front wall 134 and the rear wall 136, a transmission shaft 138 extending substantially horizontally is rotatably mounted. A rear end portion of the transmission shaft 138 is protruded rearward through the rear wall 136 of the housing 55, while a front end portion of the transmission shaft 138 is protruded forward through the front wall 134 of the housing 55. To the rear end of the transmission shaft 138, a transmission gear 140 is fixed, and to the front end of the transmission shaft 138, a transmission gear 142 is fixed. The transmission gear 140 is engaged with the transmission gear 114. To the front wall 134 of the housing 55, a short shaft 144 protruding substantially horizontally forward is fixed. On the short shaft 144, a transmission gear 146 is rotatably mounted. The rotary shaft 60 of the rotary brush means 58 of the cleaning means 54 is also rotatably mounted on the front wall 134 and the rear wall 136 of the housing 55. A front end portion of the rotary shaft 60 extending substantially horizontally is protruded forward through the front wall 134 of the housing 55. To the front end of the rotary shaft 60, a transmission gear 148 is fixed. The transmission gear 146 mounted on the short shaft 144 is engaged with the transmission gear 142 fixed to the transmission shaft 140, and also engaged with the transmission gear 148 fixed to the rotary shaft 60.

When the solenoid 128 is deenergized, namely, when the selectively connecting means 74 is in the nonoperating condition, the movable bracket 116 is positioned at the non-connecting position, and the connection control gear 120 is separated from the transmission gear 110. Thus, the rotary shaft 60 of the rotary brush means 58 is cut off from the output shaft 76 of the electric motor 68. When the solenoid 128 is energized to move the movable bracket 116 to the connecting position, thus putting the selectively connecting means 74 into the operating state, the transmission gear 110 is connected to the transmission gear 108 via the connection control gear 120. As a result, the output shaft 76 of the electric motor 68 is connected to the rotary shaft 60 of the rotary brush means 58 via the transmission gear 78, transmission gear 108, connection control gear 120, transmission gear 110, transmission gear 112, transmission gear 114, transmission shaft 138 having the transmission gears 140 and 142 fixed thereto, transmission gear 146, and transmission gear 148. Therefore, the rotation of the output shaft 76 of the electric motor 68 is transmitted to the rotary brush means 58, whereby the rotary brush means 58 is rotated in the direction of arrow 62 (FIG. 1).

In the above-described image forming machine, whenever the electric motor 64 is energized and the rotating drum 2 rotated, the electric motor 68 is also energized and the driven roller 48 of the fixing means 46 also rotated. On the other hand, there is a state in which the electric motor 64 is deenergized and the rotating drum 2 stopped, but the electric motor 68 is energized, and the driven roller 48 of the fixing means 46 rotated. When the main switch (power switch) 150 (FIG. 2) of the image forming machine is turned on, for example, the electric motor 68 is energized, and the driven roller 48 of the fixing means 46 rotated. Simultaneously, the heating means 52 of the fixing means 46 is energized, whereby the entire peripheral surface of the driven roller 48 of the fixing means 46 is heated to a required temperature enough uniformly. Then, when a start switch 152 is operated, for example, the electric motor 64 is also energized to start the rotation of the rotating drum 2, initiating the image formation process. It is advantageous that during stoppage of the rotating drum 2, the driven roller 48 is rotated at a setup rotational speed, a relatively low speed; whereas when the rotation of the rotating drum 2 is started, the rotational speed of the driven roller 48 is increased to an ordinary rotational speed.

When the electric motor 68 is energized, and the rotary brush means 58 rotated during stoppage of the rotating drum 2, a specific angle site of the electrostatic photoconductor disposed on the peripheral surface of the rotating drum 2 is continuously rubbed against the rotary brush means 58, whereby the specific angle site of the electrostatic photoconductor is locally damaged. To avoid this event, the image forming machine constructed in accordance with the present invention is constituted in the following manner: When the electric motor 64 is deenergized to keep the rotating drum 2 stopped, the control means 72 (FIG. 2) deenergizes the solenoid 128 of the selectively connecting means 74 to bring the movable bracket 116 to the non-connecting position and put the selectively connecting means 74 into the nonoperating state. Thus, the rotary brush means 58 is cut off from the electric motor 68, so that even when the electric motor 68 is energized to start the rotation of the driven roller 48 of the fixing means 46, the rotary brush means 58 is never rotated. When the electric motor 64 is energized to start the rotation of the rotating drum 2, the solenoid 128 of the selectively connecting means 74 is simultaneously energized to move the movable bracket 116 to the connecting position and set the selectively connecting means 74 into the operating state. Thus, the rotation of the rotary brush means 58 is started. When the electric motor 64 is deenergized, the solenoid 128 of the selectively connecting means 74 is also deenergized to return the movable bracket 116 to the non-connecting position and return the selectively connecting means 74 into the nonoperating state. Thus, during the stoppage of the rotating drum 2, the rotary brush means 58 is also stopped, while during rotation of the rotating drum 2, the rotary brush means 58 is also rotated.

While the preferred embodiments of the image forming machine of the present invention have been described in detail with reference to the attached drawings, it is to be understood that the invention is in no way restricted to these embodiments, but various changes or modifications may be made without departing from the spirit and scope of the invention.

What I claim is:

1. An image forming machine comprising a rotating drum having an electrostatic photoconductor on the peripheral surface thereof; a first electric motor for rotating said rotating drum; latent electrostatic image forming means for forming a latent electrostatic image on the electrostatic photoconductor; developing means for developing the latent electrostatic image on the electrostatic photoconductor to a toner image; transfer means for transferring the toner image on the electrostatic photoconductor onto a sheet member; cleaning means for removing a residual toner remaining on the electrostatic photoconductor after transfer, said cleaning means including rotary brush means in contact with the peripheral surface of said rotating drum; fixing means for fixing the toner image, transferred onto the sheet member, onto the sheet member; a second electric motor for driving said fixing means; and control means; wherein selectively connecting means is disposed which can be selectively set in an operating state for drivingly connecting the rotary brush means to said second electric motor to transmit the rotation of said second electric motor to the rotary brush means, and in a nonoperating state for cutting off the rotary brush means from said second electric motor, and said control means sets said selectively connecting means in the operating state only when said rotating drum is to be rotated.

2. The image forming machine of claim 1, wherein said selectively connecting means includes a pair of transmission gears; a connection control gear disposed so as to be movable between a connecting position at which said connection control gear engages both of said pair of transmission gears to drivingly connect together said pair of transmission gears, and a non-connecting position at which said connection control gear is separated from at least one of said pair of transmission gears to cut off said pair of transmission gears from each other; and moving means for selectively moving said connection control gear to the connecting position and the non-connecting position.

3. The image forming machine of claim 2, wherein said connection control gear is mounted on a movable bracket mounted so as to be turnably movable about the central axis of one of said pair of transmission gears, and said moving means selectively moves said connection control gear to the connecting position and the non-connecting position when the movable bracket is moved.

4. The image forming machine of claim 2, wherein said moving means is composed of a solenoid.

5. The image forming machine of claim 1, wherein said fixing means includes a driven roller and a follower roller which cooperatively work, and a heating means provided in at least one of said driven roller and said follower roller.

* * * * *